US009085867B2

(12) United States Patent
Cardis et al.

(10) Patent No.: US 9,085,867 B2
(45) Date of Patent: Jul. 21, 2015

(54) WATER-GATE

(75) Inventors: Michel Cardis, Grenoble (FR); Alain Michel, Grenoble (FR)

(73) Assignee: ALSTOM RENEWABLE TECHNOLOGIES, Grenoble (FR)

( * ) Notice: Subject to any disclaimer, the term of this patent is extended or adjusted under 35 U.S.C. 154(b) by 136 days.

(21) Appl. No.: 14/114,097

(22) PCT Filed: Apr. 25, 2012

(86) PCT No.: PCT/EP2012/057513
§ 371 (c)(1),
(2), (4) Date: Oct. 30, 2013

(87) PCT Pub. No.: WO2012/146595
PCT Pub. Date: Nov. 1, 2012

(65) Prior Publication Data

US 2014/0050529 A1 Feb. 20, 2014

(30) Foreign Application Priority Data

Apr. 26, 2011 (FR) ..... 11 53565

(51) Int. Cl.
*E02B 7/20* (2006.01)

(52) U.S. Cl.
CPC ..... *E02B 7/20* (2013.01)

(58) Field of Classification Search
USPC ..... 405/87, 92–96, 107
See application file for complete search history.

(56) References Cited

U.S. PATENT DOCUMENTS

| | | | | |
|---|---|---|---|---|
| 7,951,291 | B2 * | 5/2011 | Nino | 210/131 |
| 2013/0022402 | A1 * | 1/2013 | Cardis et al. | 405/99 |

FOREIGN PATENT DOCUMENTS

| | | | |
|---|---|---|---|
| CH | 383 273 | A | 10/1964 |
| CN | 1032967 | A | 5/1989 |
| CN | 2417200 | Y | 1/2001 |
| CN | 2861274 | Y | 1/2007 |
| CN | 201502052 | U | 6/2010 |
| DE | 845329 | C | 7/1952 |
| EP | 1 972 722 | A1 | 9/2008 |
| FR | 1316555 | A | 2/1963 |

OTHER PUBLICATIONS

First Office Action issued on Sep. 28, 2014, by the State Intellectual Property Office of the People's Republic of China in Chinese Patent Application No. 201280020740.0, and an English translation of the Office Action. (14 pages).

International Search Report re Application No. PCT/EP2012/057513, mailed on Nov. 20, 2012.

* cited by examiner

*Primary Examiner* — Benjamin Fiorello
*Assistant Examiner* — Kyle Armstrong
(74) *Attorney, Agent, or Firm* — Buchanan Ingersoll & Rooney PC

(57) ABSTRACT

A water-gate is intended to withstand pressure exerted by a liquid. The water-gate includes an essentially flat shell plate and a plurality of thin cores extending along the length of the shell plate, the thin cores being substantially parallel to one another. Each core is solidly connected to the shell plate and pierced with multiple disjoint holes. According to the disclosure, the water-gate comprises at least one stiffener formed by assembling multiple elements that are aligned along a longitudinal axis of the stiffener and that each extend between the cores without passing through the cores. Each element may be solidly connected to a face of at least one core around one of the holes.

10 Claims, 4 Drawing Sheets

WATER-GATE

CROSS-REFERENCE TO RELATED APPLICATIONS

This application is a U.S. National Phase of International Application No.: PCT/EP2012/057513, filed Apr. 25, 2012, designating the U.S., and published in French as WO 2012/146595 on Nov. 1, 2012, which claims the benefit of French Patent Application No. 1153565 filed Apr. 26, 2011.

This invention relates to a water-gate intended to withstand a pressure exerted by a liquid over all or a portion of its surface. Water-gate here designates an essentially flat structure able to retain a free surface liquid.

When it is in service, a water-gate separates a downstream basin from an upstream basin wherein the liquid to be retained is located. This liquid subjects the water-gate to a distributed pressure, which varies according to time and to the distance to the bottom of the gate. A water-gate therefore works under stress since it is subjected to cyclical stresses. In addition, certain gates, such as rolling, lifting or lowering gates, work substantially in flexure, both according to a vertical direction and according to a horizontal direction.

The structure of known water-gates generally comprises an essentially flat shell plate located on the downstream side, as well as several cores or webs extending horizontally along the shell plate, each core being solidly connected to this plate in order to take up the stresses to which it is subjected. Indeed, the hydraulic pressure exerted on the gate is generally transmitted to two vertical risers located respectively on each side of the gate, which implies the installation of horizontal cores along the shell plate. These cores can have a solid or lattice structure.

In addition, a conventional water-gate generally comprises secondary horizontal stiffeners parallel to the cores as well as vertical stiffeners making it possible to provide the vertical rigidity of the structure. Certain vertical stiffeners can have a form of web widening towards the bottom of the structure.

In general, the horizontal cores, the secondary horizontal stiffeners and the vertical stiffeners are welded onto the shell plate in order to take up the stresses that the latter is subjected to. Moreover, the solid cores must themselves be provided with longitudinal and transverse stiffeners in order to prevent them from webbing according to a vertical direction.

The structure of a conventional gate therefore has the disadvantage of requiring very many welds which form between them as many cross welds. However, such cross welds weaken the structure when it is working under fatigue, as is the case for water-gates. In particular, the transverse welds, which extend according to a substantially vertical direction, resist poorly to the variations in the stresses according to the height of the liquid and particularly to the differences between the stresses exerted above and those exerted below the free surface of the liquid.

EP-A-1 972 722 discloses a water-gate which comprises several thinned cores extending horizontally along the shell plate. Each core has several essentially circular holes. At least one tubular stiffener extends through the holes of several successive cores and is welded to the cores, on the periphery of the holes. This structure requires fewer welds than a conventional water-gate, and is more resistant to flexure and to fatigue. However, it is relatively complex to manufacture such a water-gate as the holes that the stiffener passes through have to be carried out with precise dimensions so as to obtain a satisfactory contact between the stiffener and the cores, with the purpose of providing for the solidity of the welds.

To this effect, the invention relates to a water-gate, intended to withstand a pressure exerted by a liquid. The water-gate comprises an essentially flat shell plate and a plurality of thin cores extending along the shell plate and substantially parallel to one another. Each core is solidly connected to the shell plate and each core is pierced with several disjoint holes. The water-gate of the invention comprises at least one stiffener formed by assembling several elements which are aligned along a longitudinal axis of the stiffener and which each extend between the cores, without passing through the cores. Each element is solidly connected to a face of at least one core, around one of the holes.

Thanks to the invention, the structure of the water-gate no longer requires or requires very few transverse welds, to the extent that its resistance to fatigue is improved. In addition, the stiffeners do not pass through the horizontal cores since they are comprised of several elements assembled on either side of the cores, which facilitates the manufacture of the water-gate.

According to other advantageous but optional characteristics of the invention, taken individually or in any technically permissible combination:

- for each core and in the plane of a core, the holes have a maximum dimension less than a maximum dimension of the stiffener; for each element, an annular portion of the core extends between this element and the hole around which this element extends;
- each stiffener is cylindrical with a circular section in that the elements of the stiffener are tubular;
- the water-gate comprises soles each solidly connected to a single core, by means of weld lines extending over a substantial portion of the respective curved edges of the cores;
- the unit constituted by a core and the sole solidly connected to this core form a beam of which the transverse section is in the shape of a "T";
- the water-gate is manufactured by assembling between them several portions each comprised of a portion of the shell plate, of several cores and of several elements of each stiffener;
- the elements of the stiffener which are located on interfaces between two adjacent portions are solidly connected directly to one another, in particular by welding or by means of bolts;
- the gate comprises several stiffeners;
- each core comprises a hole arranged between two adjacent stiffeners, this hole not being surrounded by a stiffener;
- the gate comprises at least three stiffeners, the stiffeners include at least one central stiffener and two lateral stiffeners which are located between the central stiffener and a lateral riser of the water-gate and in the plane of a core, each central stiffener has a maximum dimension greater than a maximum dimension of the lateral stiffeners.

The invention shall be better understood and other advantages of the latter shall appear more clearly when reading the following description of a water-gate, provided solely by way of example and made in reference to the annexed drawings wherein.

Figure 1:
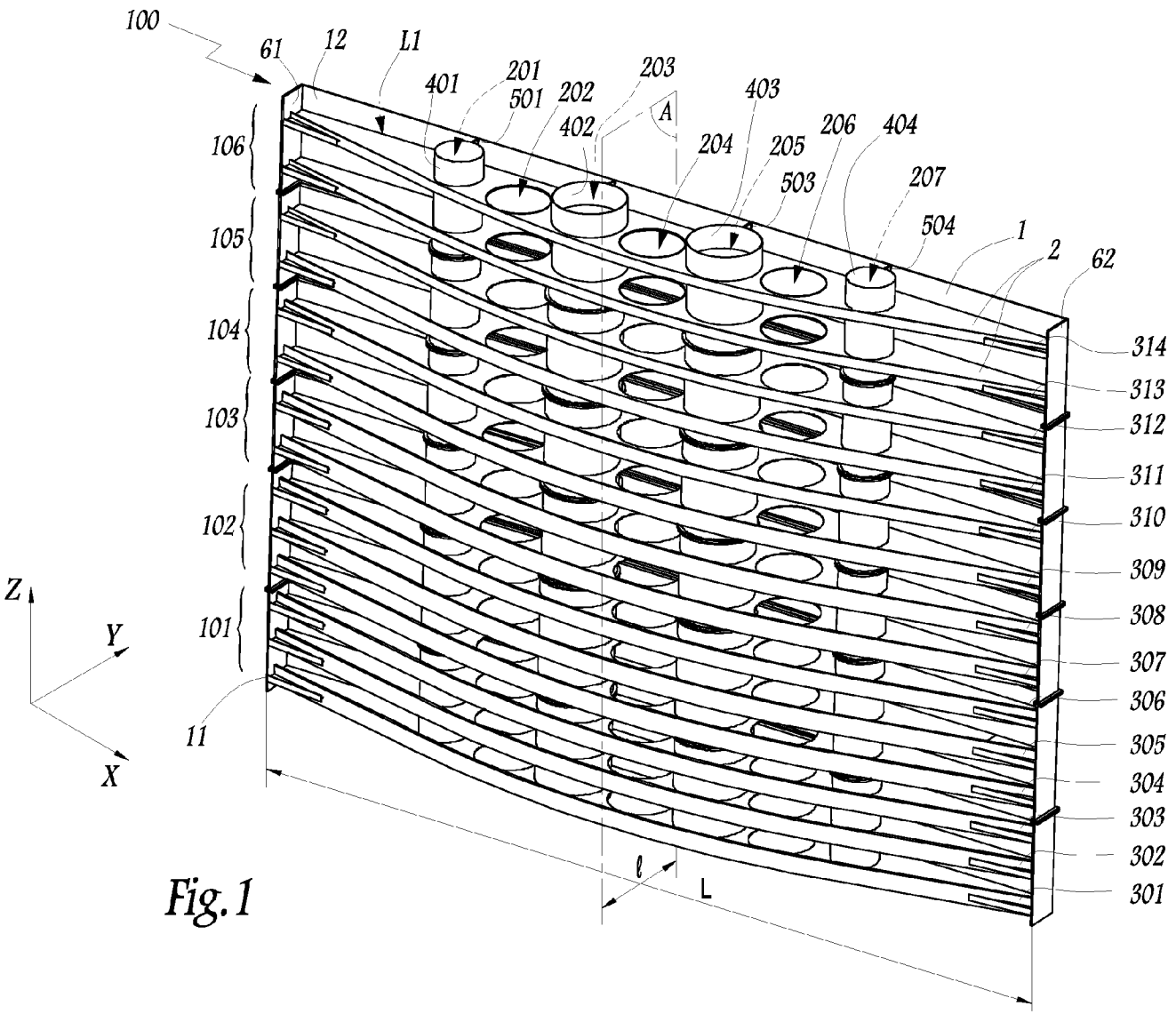
FIG. 1 is a perspective view of a water-gate in accordance with the invention.

FIG. 1 shows a planar structure able to form a water-gate 100. In the example of the figures, the water-gate is a lifting gate, i.e. it is lifted in vertical translation in order to allow for the communication of the upstream and downstream basins. For this, hooking elements not shown are provided on each side of the structure in order to make it possible to fasten the water-gate onto an elevation mechanism known per se and which is not described.

Alternatively, the water-gate 100 can be lowering or rolling.

Three axes X, Y and Z forming an orthogonal coordinate system are shown in FIG. 1. The axis Z coincides with an essentially vertical direction when the water-gate 100 is installed in the sluice. X-Y denotes a plane passing through the axes X and Y, X-Z denotes a plane passing through the axes X and Z and Y-Z denotes a plane passing through the axes Y and Z. In service, the plane X-Y is essentially horizontal and the planes X-Z and Y-Z are essentially vertical.

In what follows, the adjectives "upper" and "lower" refer to the orientation of the gate 100 in FIG. 1, where a lower end 11 of the gate 100 is at the bottom of the axis Z, while an upper end 12 is at the top of the axis Z.

The water-gate 100 comprises an essentially flat shell plate 1 which extends parallel to the plane X-Z. The shell plate 1 has a width L, measured along the axis X, corresponding substantially to the width of the channel to be controlled in the case of a raising, lowering or rolling water-gate. In the example of the figures, the width L is equal to approximately 26 m. The shell plate 1 is intended to be placed on the downstream side of the gate 100. In other words, the external face of the shell plate 1, oriented towards the rear of FIG. 1, is intended to be turned towards a downstream basin.

The water-gate 100 further comprises two lateral risers 61 and 62 which are parallel to the axis Z and which are located respectively at each lateral end of the shell plate 1. The risers 61 and 62 are comprised of essentially rectangular and narrow plates and mounted perpendicularly to the shell plate 1. The risers 61 and 62 are integrally formed with the shell plate 1, for example by means of an operation of folding or of welding on each lateral end of the shell plate 1.

The water-gate 100 is manufactured by assembling six portions 101 to 106 superposed on one another along the axis Z. The portions 101 to 106 are arranged between the ends 11 and 12 of the water-gate 100.

As such, the shell plate 1 is comprised of six flat sheet metal strips each corresponding to one of the portions 101 to 106 and extending longitudinally along the axis X. These strips are assembled together, for example by means of bolts, bolted joint covers or welds which can be carried out on site, during the assembly on site. In the same way, the risers 61 and 62 are each comprised of six rectangular sheet metal plates each corresponding to one of the portions 101 to 106.

The water-gate 100 moreover comprises fourteen thin and flat cores 2 which extend between the risers 61 and 62, parallel to the plane X-Y. The number of cores 2 belonging to the gate 100 depends in particular on the height of the gate 100 and it can be for example between ten and twenty-five.

Thin core designates a core of which the thickness is low in terms of its other dimensions and in particular in terms of its width. The cores 2 are here formed by planar plates and identical to one another. They can each have a thickness between 10 mm and 100 mm, according to the pressure that the water-gate 100 has to withstand.

Figure 4:
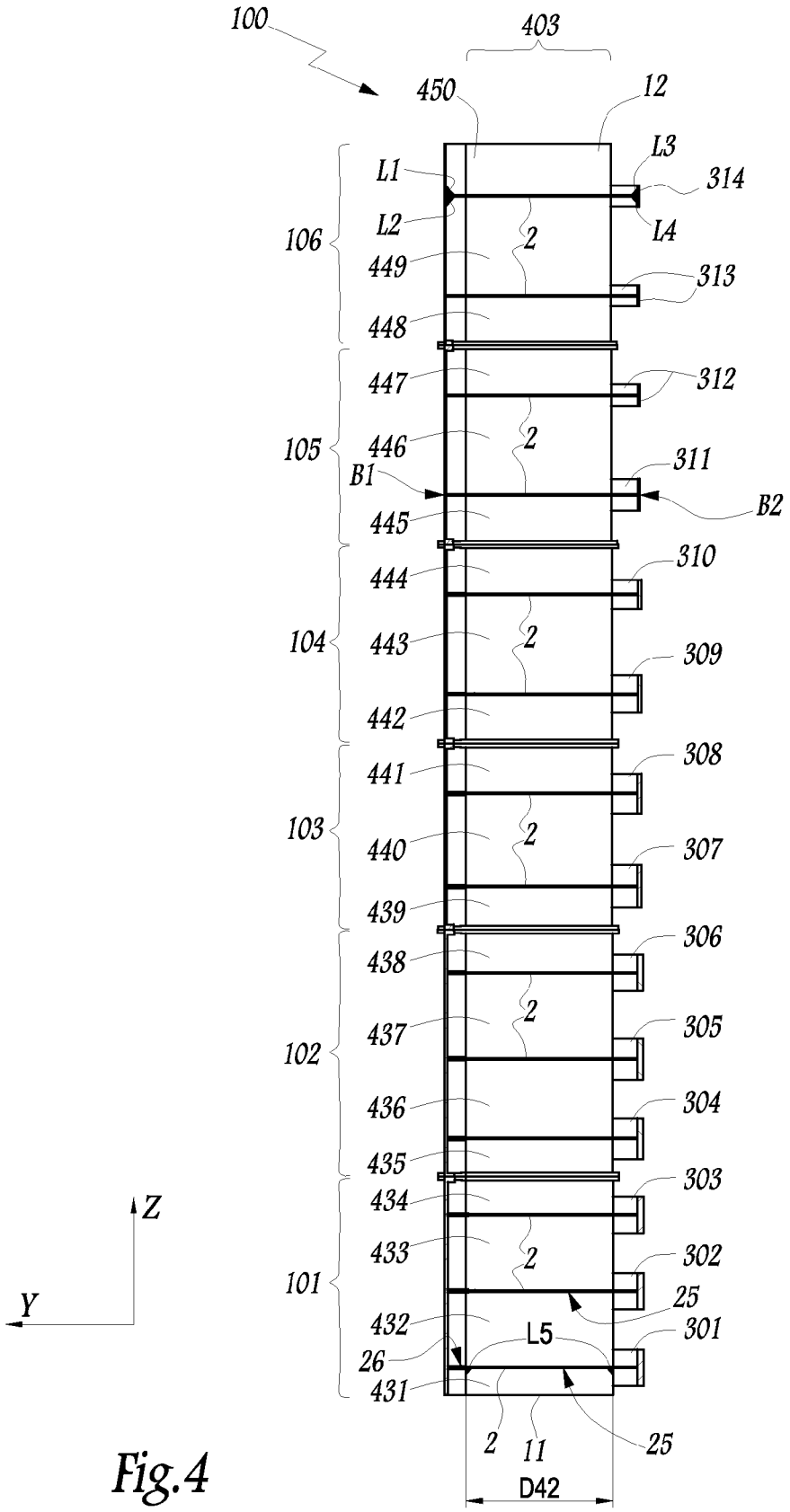
FIG. 4 is a cross-section according to the plane A in FIG. 1.

Each core 2 is solidly connected to the shell plate 1 by means of two weld lines L1 and L2 extending over a substantial portion, and more preferably over the totality, of the length L of the shell plate 1 and on either side of the core 2. In FIG. 4, the weld lines L1 and L2 are shown solely for the core 2 located at the top, with the understanding that other similar weld lines connect each core 2 to the shell plate 1. In addition, each core 2 is welded by its ends to each riser 61 or 62. The welds are dimensioned in such a way as to withstand the stresses when the liquid exerts a pressure on the water-gate.

For each core 2, an edge B1 intended to be welded onto the shell plate 1 has a straight profile in such a way as to hug the planar shape of the shell plate 1. On the side opposite the shell plate 1, each core 2 is delimited by an edge B2 which has an essentially curved profile in the plane X-Y. This profile is defined in such a way that a core 2 widens, according to the direction Y, towards its middle and narrows towards its ends. This makes it possible to confer to the cores 2 a good resistance in flexure according to the direction Y. Here, each core 2 has a parabolic edge B2 with a width $\ell$ in its middle of approximately 3 m and a width $\ell'$ on its ends of approximately 50 cm.

On the side opposite the shell plate 1, the water-gate 100 comprises fourteen soles 301 to 314, each constituted of a thin sheet metal strip and each extending vertically over the edge B2 of a core 2 and horizontally between the risers 61 and 62. Each sole 301 to 314 is solidly connected to a core 2 in such a way as to rigidify it.

The soles 301 to 314 can for example be welded onto the cores 2 by means of weld lines L3 and L4 extending all along each of the edges B2 of the cores 2, or over a substantial portion of these edges. The weld lines L3 and L4 are shown solely for the sole 314 located at the top in FIG. 4, with the understanding that other similar weld lines connect each sole 301 to 314 to the shell plate 1.

The soles 301 to 314 are arranged successively, along the axis Z, on top of one another, with the sole 301 solidly connected to the core 2 located at the bottom in FIG. 4 and the sole 314 solidly connected to the core 2 located at the top in FIG. 4.

The unit formed by each core 2 and the sole 301 to 314 solidly connected to this core 2 defines a beam which has a transverse section, perpendicular to the plane X-Y, in the shape of a T. These beams structure the water-gate 100, as such contributing to its mechanical resistance.

In that a sole 301 to 314 hugs the edge B2 of each core 2, the soles 301 to 314 also have an essentially parabolic profile, which makes it possible to obtain a compression force supported by each sole 301 to 314 which is practically constant along cores 2 and compensating the cutting force being exercised in each section of a sole 301 to 314 except, possible, on its lateral ends.

Curved profiles other than parabolic, for example elliptical, can be used to carry out the edges B2 of the cores 2 and the soles 301 to 314 with the purpose of distributing and balancing such forces, with the central portion of each core 2 being wider than its ends.

Moreover, each core 2 has seven disjoint holes 201 to 207 which are distributed along its central portion. The holes 201 to 207 are arranged at the same location for each core 2 and extend successively next to one another, along the axis X. The holes 201 to 207 are circular and d201 to d207 denote their respective diameters. The holes 201 to 207 of each core 2 are symmetrical in relation to the plane A. As such, the diameters d201, d202 and d203 are respectively equal to the diameters d207, d206 and d205, the hole 204 being centred on the plane A. The diameter d201 to d207 of each hole 201 to 207 is less than the width of the segment of the core 2 where this hole 201 to 207 is located.

The holes 201 of the different cores 2 are aligned along the same axis Z201 parallel to the axis Z. In the same way, the holes 202 to 207 of the cores 2 are aligned together along the same axis, not shown, parallel to the axis Z.

The water-gate 100 further comprises four stiffeners 401 to 404 in the form of a hollow cylinder with a circular base, which extends parallel to the axis Z. The stiffeners 401 and 404 are closer to the risers 61 and 62 than the stiffeners 402 and 403. Along the axis X, the stiffeners 402 and 403 are located between the stiffeners 401 and 404. In other words, the stiffeners 402 and 403 are central stiffeners located between the lateral stiffeners 401 and 404.

The stiffeners 401 to 404 are coaxial respectively with the holes 201, 203, 205 and 207. As such, the stiffener 401 is aligned according to the axis Z201 with the holes 201 of the different cores 2. In other words, a central longitudinal axis Z401 of the stiffener 401 is aligned with the axis Z201 of holes 201. In the same way, the stiffeners 402 to 404 are respectively aligned in parallel to the axis Z with the holes 203, 205 and 207. The holes 202, 204 and 206 are each located between two adjacent stiffeners 401 to 404.

In the plane of a core 2, the central stiffeners 402 and 403 have a diameter D42 greater than the diameter D41 of the lateral stiffeners 401 and 404. The stiffeners 401 and 404 have a diameter D41 greater than the diameter d201 and d207 of the holes 201 and 207. The stiffeners 402 and 403 have a diameter D42 greater than the diameter d203 and d205 of holes 203 and 205.

Figure 2:
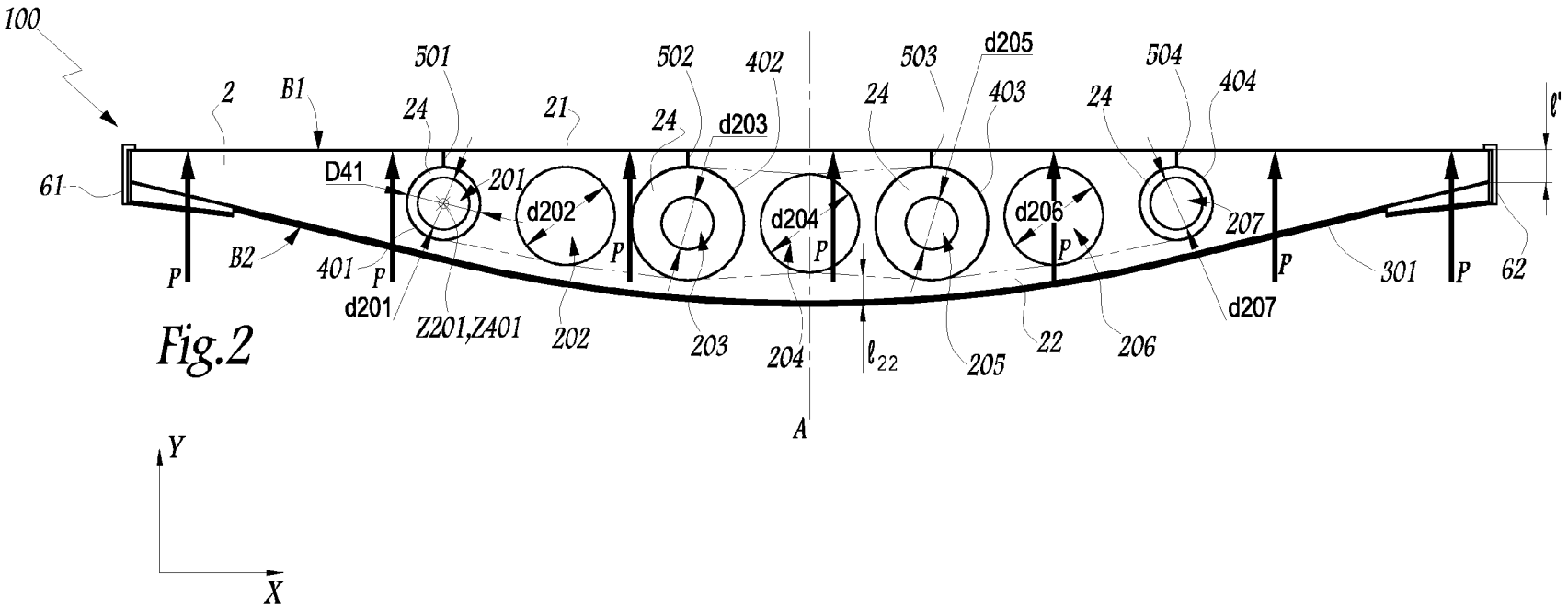
FIG. 2 is a top view of the water-gate of FIG. 1.

As such, as shown in FIG. 2, for each core 2, an annular portion 24 extends around each hole 201, 203, 205 and 207, between the hole and the lateral wall of the corresponding stiffener 401 to 404.

The annular portions 24 have an inner diameter corresponding to the respective diameters d201, d203, d205 and d207 of the holes 201, 203, 205 and 207, and an outer diameter corresponding to the diameter D41 and D42 of the stiffeners 401 to 404. As such, the annular portions 24 delimited by the stiffeners 402 and 403 have an outer diameter that is greater than the outer diameter of the annular portions 24 delimited by the stiffeners 401 and 404.

Figure 3:
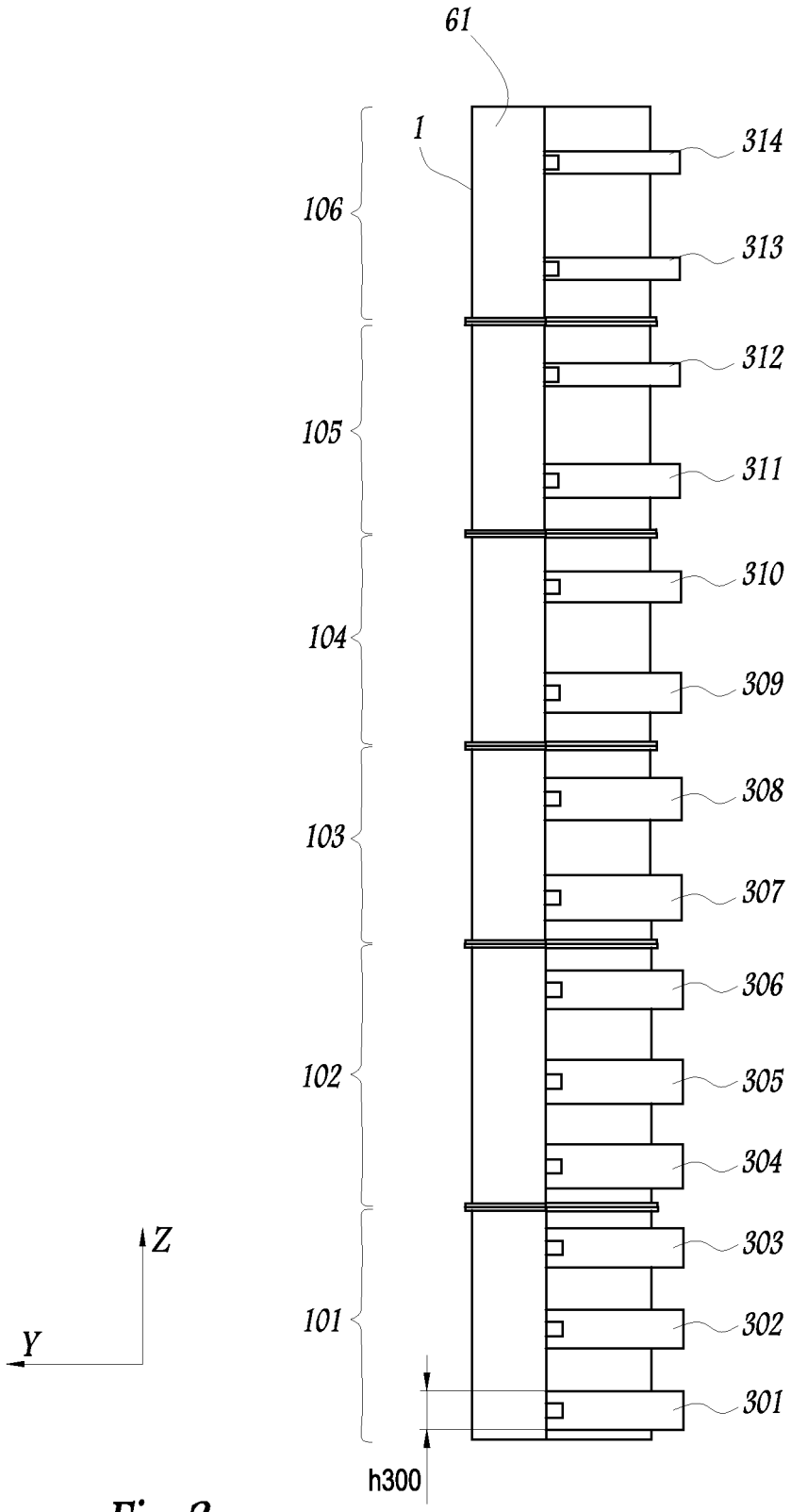
FIG. 3 is a side view of the water-gate of FIG. 1.

The holes 202, 204, 206 and the stiffeners 401 to 404 delimit together a first strip 21 along the straight edge B1 in the vicinity of the shell plate 1, a second strip 22 along the edge B2 as well as bridges 23 connecting between them the strips 21 and 22 and extending perpendicularly to the edge B1 between two neighbouring holes 201 to 207. In FIG. 3, the strips 21 and 22 are materialised by dotted lines essentially parallel to each longitudinal edge B1 and B2 of the core 2. The cores 2 are therefore of the "bow-string" type.

The circular shape of the upstream and downstream ends of each bridge 23 allows for a progressive distribution of the stresses between the strips 21 and 22 and the bridges 23. The holes 201 to 207 could have other shapes, as long as they delimit regions similar to the strips 21, 22 and to the bridges 23.

When the liquid exerts a pressure P distributed over the shell plate 1, each strip 21 works in traction, as it is subjected to stresses oriented according to the longitudinal direction X of the core 2. As such, the strips 21 cannot become webbed, i.e. be deformed outside of a horizontal plane parallel to the plane X-Y.

The strips 22 work in compression, but they are rigidified by the soles 301 to 314 which are welded to them perpendicularly. The strips 22 therefore have a low risk, even zero, of webbing according to the axis Z. Indeed, the soles 301 to 314 constitute with the strips 21 elements with a section in the shape of a "T" having a moment of inertia that is relatively substantial in relation to the axes Y and Z.

The width $\ell$ 22 of a strip 22, taken parallel to the Y axis, i.e. perpendicularly to the vertical and to the length L of the core 2, is less than twenty times, and more preferably fifteen times, the thickness the core 2. Such a dimensioning makes it possible to further reduce the risk of webbing of the strips 22 in service.

Preferably, the width of the annular portions 24, measured radially between each hole 201, 203, 204 and 207 and the corresponding stiffener 401 to 404, is less than the width $\ell$ 22.

The bridges 23 work in traction, i.e. they transmit transverse forces to the strips 21 and 22. The bridges 23 therefore have a low risk of webbing, even zero.

The shell plate 1, the cores 2, the risers 61 and 62 and the soles 301 to 314 are constituted by at least one metal having good mechanical properties and a good weldability, such as grade S355J2 construction steel.

Each stiffener 401 to 404 is multipartite, i.e. it is comprised of several tubular elements aligned according to its longitudinal axis, parallel to the axis Z. As such, the tubular elements do not pass through the cores 2 but are welded on other side of the cores 2, around annular portions 24.

As shown in FIG. 4, the stiffener 403 comprises twenty tubular elements 431 to 450 arranged successively on top of one another between the ends 11 and 12 of the gate 100. As such, the tubular element 431 extends on the lower end 11 of the water-gate 100 and the tubular element 450 extends on the upper end 450 of the water-gate 100.

In the same way, the stiffeners 401, 402 and 404 further include twenty tubular elements arranged successively on top of one another.

Four tubular elements 431 to 434, 435 to 438 and 439 to 441 extend on each of the three lower portions 101 to 103 of the water-gate 100. Three tubular elements 442 to 444, 445 to 447 and 448 to 450 extend on each of the three upper portions 104 to 106.

With regards to the lower portion 101, the tubular element 431 extends longitudinally between the lower end 11 of the gate 100 and the core 2 which is located at the bottom in FIG. 4 and solidly connected to the sole 301. The tubular element 431 can for example be welded onto the lower face 25 of this core 2 by means of a weld line L5 extending along the entire inner periphery of the tubular element 431, or over a substantial portion of this periphery.

The tubular element 432 extends between the upper face 26 of the core 2 solidly connected to the sole 301 and the lower face 25 of the core 2 solidly connected to the sole 302. The tubular element 432 can for example be welded onto the faces 25 and 26 of the corresponding cores 2 by means of weld lines not shown extending over the inner periphery of the tubular element 432. In the same way, the tubular element 433 extends between the core 2 solidly connected to the sole 302 and the core 2 solidly connected to the sole 303.

Two tubular elements 434 and 435 extend between the core 2 solidly connected to the sole 303 and the core 2 solidly connected to the sole 304. As such, the upper end of the tubular element 434 is assembled, for example by welding or by means of bolts, to the lower end of the tubular element 435.

For the portions 102 to 106, the tubular elements 435 to 450 are assembled to the faces 25 and 26 of the cores 2 in a manner similar to the portion 101.

As such, each element 431 to 450 is solidly connected to a face 25 or 26 of at least one core 2, around one of the holes 201, 203, 205 and 207. In other words, each element 431 to 450 is solidly connected to a face 25 or 26 of at least one core 2, around each of the holes 201, 203, 205 or 207 to the right of which is mounted this element 431 to 450, i.e. vertically or directly in line with the holes 201, 203, 204 or 207, along the longitudinal axis Z401 of the stiffener 401 to 404 formed by the assembling of this element 431 to 450.

The elements 434, 435, 438, 439, 441, 442, 444, 445, 447, 448 of each stiffener 401 to 404 are located on interfaces between two adjacent portions 101 to 106 and are solidly connected directly to one another.

As such, it is possible to manufacture each of the portions 101 to 106 separately, then to assemble the portions 101 to 106 together, for example on the site where the water-gate 100 will be used.

The portions 101 to 106 are each comprised of a portion of the shell plate 1, of a portion of the risers 61 and 62, of several cores 2 and of soles 301 to 314 solidly connected to these cores 2. Moreover, each portion 101 to 106 comprises several tubular elements 431 to 450.

The tubular elements 448, 449 and 450 of the stiffener 401 are located on the upper portion 106 and are connected to the shell plate by a sheet metal plate 501. In the same way, the tubular elements of the stiffeners 402, 403 and 404 which are located on the portion 106 are connected to the shell plate by a sheet metal plate 502, 503 or 504.

The plates 501 to 504 are multipartite and are comprised of several elements that extend in parallel to the axis Z between the cores 2. Each element constituting the plates 501 to 504 is welded, on the one hand, to the tubular elements 448, 449, 450 and equivalents of the stiffeners 401 to 404 and, on the other hand, to the corresponding cores 2.

As such, the stiffeners 401 to 404 are solidly connected to the shell plate 1, which blocks in particular the vertical translation, according to the axis Z, of the stiffeners 401 to 404 in relation to the shell plate 1. This contributes to increasing the mechanical resistance of the water-gate 100, in particular the resistance to buckling of the soles 301 to 314.

The stiffeners 401 to 404 being solidly connected to the cores 2, they take up a portion of the forces exerted on the cores 2 according to the axis Z. The stiffeners 401 to 404 increase the vertical rigidity of the entire water-gate 100 and its mechanical resistance to the pressure P. The stiffeners 401 to 404 can each connect all the cores 2 or only a portion together, according to the needs of the desired application. Alternatively, the stiffeners 401 to 404 can be solid. It is also possible, if needed, to arrange other tubular elements through the neighbouring holes 202, 204 and 206 of holes 201, 203, 205 and 207. Moreover, the stiffeners 401 to 404 can be comprised of tubular elements with a non-circular section, but, for example, elliptical or polygonal.

Consequently, the "bow-string" type structure of the cores 2, rigidified by the stiffeners 401 to 404, allows the water-gate 100 to withstand the stresses generated by the pressure P of the liquid on the shell plate 1 and on the soles 301 to 314, without any substantial risk of webbing.

As the stiffeners 401 to 404 are hollow and as the cores 2 have free holes 202, 204 and 206, water can easily rise up the height of the water-gate 100, which avoids the momentary differences in stresses between neighbouring regions and improves the mechanical resistance of the water-gate 100.

As can be seen in FIG. 4, h300 denotes a height of the soles 301 to 341, measured along the axis Z. The height h300 corresponds to the width of the sheet metal strip which constitutes the soles 301 to 314. The soles 301 to 341 have a height h300 that decreases upwards. In other words, the height h300 of the sole 301 is greater than the height h300 of the sole 314. In the same way, the section of the soles 301 to 314 decreases upwards. In addition, the cores 2 located at the bottom of the water-gate 100 are closer to one another than the cores 2 located at the top of the water-gate 100. Finally, the height of the portions 101 to 106, according to the axis Z, decreases between the ends 11 and 12 of the gate 100. This is to be put into relation with the fact that the forces undertaken by the water-gate 100, on its lower end 11, are greater than on its upper end 12, given that the water retained by the water-gate 100 exerts a pressure P which increases when moving towards the bottom according to the axis Z between the ends 12 and 11.

Such a water-gate requires less welds than the gates of prior art, which makes it possible to reduce the mass of the water-gate 100. As such, it is possible to reduce the thickness of the sheet metal elements which comprise the water-gate 100. In addition, these welds extend essentially according to the same directions as the main stresses that the gate is subjected to, which increases their resistance and that of the water-gate, in particular to fatigue. Indeed, in the water-gate 100 of the invention, the welds that are the most affected by the fatigue phenomenon are suppressed. Thanks to the water-gate 100 of the invention, it is not necessary to carry out the holes 201, 203, 205 and 207 with precise geometrical tolerances, as the tubular elements 431 to 450 and equivalents do not pass through the holes but are welded to the cores 2, in the vicinity and around the holes. As such, the manufacture of the water-gate 100 of the invention is relatively easy. Indeed, if the tubular elements 431 to 350 and equivalents were to pass through the holes 201, 203, 205 and 207, it would be necessary to have a precise adjustment of the tubular elements and of the holes, in such a way as to provide a satisfactory contact between these elements, for the purpose of providing for the solidity of the welds. With regards to the water-gate 100 of the invention, it is sufficient for the height of the tubular elements to be equal to the spacing between two adjacent cores in order to provide for the quality of the welds, which is easier to carry out.

On the other hand, the annular portions 24 constitute additional material which takes on the forces that the water-gate 100 is subjected to and contributes to providing for its mechanical resistance. In addition, the solidity of the welds L5 connecting the tubular elements 431 to 450 and equivalents of the stiffeners 401 to 404 with the faces 25 and 26 of the cores 2 is relatively high.

Moreover, the water-gate 100 formed as such is substantially lessened, on the one hand, thanks to the holes 201 to 207 and to the low thickness of the cores 2 and, on the other hand, thanks to the reduction in the number of welds required. Such a gate 100 has, at an equal mass, a mechanical resistance in fatigue and in flexure that is greater than those of gates of prior art.

Alternatively, the holes 201 to 207 may not be circular, and in this case the diameter d200 corresponds to a maximum dimension of the holes, measured in the plane of a core 2.

Alternatively, the stiffeners 401 to 404 are not cylindrical with a circular base. In this case, the diameters D41 and D42 correspond to a maximum dimension of the stiffeners, measured in the plane of a core 2.

Moreover, in the framework of the invention, the different alternatives described hereinabove can be combined together, entirely or partially.

The invention claimed is:

1. A water-gate, intended to withstand a pressure exerted by a liquid, the water-gate comprising an essentially flat shell plate, a plurality of thin cores extending along the shell plate and substantially parallel to one another, each core being solidly connected to the shell plate, each core being pierced with a plurality of disjoint holes, wherein the water-gate comprises at least one stiffener formed by assembling a plurality of elements which are aligned along a longitudinal axis of the stiffener and which each extend between the cores, without passing through the cores, and wherein each element is solidly connected to a face of at least one core, around one of the holes.

2. The water-gate according to claim 1, wherein for each core and in a plane of the core, the holes have a maximum dimension less than a maximum dimension of the stiffener and in that wherein for each element, an annular portion of the core extends between the element and the hole around which the element extends.

3. The water-gate according to claim 1, wherein each stiffener is cylindrical with a circular section and wherein the elements of the stiffener are tubular.

4. The water-gate according to claim 1, further comprising soles each solidly connected to a single core, by means of weld lines extending over a substantial portion of the respective curved edges of the cores.

5. The water-gate according to claim 4, wherein a unit constituted by a core and the sole solidly connected to the core forms a beam of which the transverse section is in the shape of a "T".

6. The water-gate according to claim 1, wherein it is manufactured by assembling together several portions each comprised of a portion of the shell plate, of several cores and of several elements of each stiffener.

7. The water-gate according to claim 6, wherein the elements of the stiffener, which are located on interfaces between two adjacent portions, are solidly directly connected to one another, in particular by welding or by means of bolts.

8. The water-gate according to claim 1, further comprising several stiffeners.

9. The water-gate according to claim 8, wherein each core comprises a hole arranged between two adjacent stiffeners, with this hole not being surrounded by a stiffener.

10. The water-gate according to claim 8, wherein it comprises at least three stiffeners wherein the stiffeners include at least one central stiffener and two lateral stiffeners which are located between the central stiffener and a lateral riser (61, 62) of the water-gate and wherein in the plane of a core, each central stiffener has a maximum dimension greater than a maximum dimension of the lateral stiffeners (401, 404).

* * * * *